United States Patent [19]

von der Eltz

[11] 4,094,636

[45] June 13, 1978

[54] PROCESS FOR DYEING CELLULOSE FIBERS WITH WATER-INSOLUBLE AZO DYESTUFFS PRODUCED ON THE FIBER

[75] Inventor: Hans-Ulrich von der Eltz, Frankfurt am Main, Germany

[73] Assignee: Hoechst Aktiengesellschaft, Frankfurt (Main), Germany

[21] Appl. No.: 763,557

[22] Filed: Jan. 28, 1977

[30] Foreign Application Priority Data

Jan. 30, 1976 Germany ..... 2603444

[51] Int. Cl.[2] ..... C09B 27/00; D06P 3/12

[52] U.S. Cl. ..... 8/46; 8/41 R; 8/54.2

[58] Field of Search ..... 8/46, 54.2

[56] References Cited

U.S. PATENT DOCUMENTS

| | | | |
|---|---|---|---|
| 3,051,542 | 8/1962 | Bosshard et al. | 8/46 |
| 3,288,552 | 11/1966 | Streck | 8/44 |
| 3,485,572 | 12/1969 | Taube et al. | 8/62 |
| 3,713,767 | 1/1973 | Lowenfeld et al. | 8/21 C |
| 3,920,386 | 11/1975 | Beyer et al. | 8/21 C |
| 3,961,886 | 6/1976 | Hertel et al. | 8/44 |

FOREIGN PATENT DOCUMENTS

| | | |
|---|---|---|
| 1,087,673 | 10/1967 | United Kingdom. |
| 1,422,995 | 1/1976 | United Kingdom. |

*Primary Examiner*—A. Lionel Clingman

*Attorney, Agent, or Firm*—Curtis, Morris & Safford

[57] ABSTRACT

Diazotizable primary aromatic amines containing a carboxylic acid ester or -amide group are useful for preparing azo dyestuffs on cellulose fibers.

2 Claims, No Drawings

PROCESS FOR DYEING CELLULOSE FIBERS WITH WATER-INSOLUBLE AZO DYESTUFFS PRODUCED ON THE FIBER

This invention relates to a process for dyeing cellulose fibers with water-insoluble azo dyestuffs produced on the fiber.

British Pat. No. 1,422,995 relates to a process for the single-bath dyeing of cellulose fibers using water-insoluble azo dyestuffs produced on the fiber, wherein the textile material is treated at a temperature within the range of from room temperature to a moderately elevated temperature with an aqueous bath containing, besides an alkaline agent, sodium nitrite and an anionic dispersing agent, the solution or dispersion of at least one azoic coupling component and at least one non-diazotized primary aromatic amine in a water miscible organic solvent or solubilizer and, after adsorption of the coupling component, diazotation of the amine and formation of the dyestuff are brought about at room temperature by adding an acid or acid salts to the bath.

This process has the drawback that some amine dispersions become unstable, especially on standing for a prolonged period of time, that special care is required for preparing the dispersions and that selected dispersing agents and additional solvent must be used.

It is also known to print and dye textile webs of cellulose fibers according to the so-called ice-color technique using developing dyes. In this process, water-insoluble azo dyes are produced on the fiber. In general, the textile material is first impregnated with the alkaline solution of the coupling component and, optionally after drying, the material is treated with the acid bath or printing paste of the diazo component, whereby the water-insoluble azo dyestuff is formed on the fiber. The material is then rinsed, soaped and dried. This mode of operation necessitates an additional process, i.e. the impregnation. Moreover, some of the diazonium salts have marginal stability so that the shade may vary from end to end in continuous dyeing.

Numerous proposals have been made to overcome these disadvantages. It is possible, for example, to use the diazonium component in the form of the anti-diazotates or diazoamino compounds, the preparation of which is rather expensive. In other processes free amines are used, for example in those of German Pat. Nos. 638,878, 644,070, 661,496 and 729,846, which amines are applied to the fiber in the presence of alkali metal salts of coupling components and sodium nitrite and are diazotized by an acid passage. Azo coupling is then brought about by drying or exposing to air. This mode of operation is complicated and little reproducible.

It has also been proposed to print the material with dispersed amines and alkaline solutions of coupling components and sodium nitrite and to develop the dyestuff by acid steaming. However, when the printing pastes are allowed to stand for a prolonged period of time, the lack of stability of the dispersed amines causes some difficulties and the preparation of dispersions is not very easy. In general, the process must be carried out very cautiously with selected dispersing agents or additional solvents have to be used.

It has now been found that the aforesaid difficulties do not arise or at least that they are distinctly reduced when in such a process primary amines are used carrying a carboxylic acid ester or amide group.

It is, therefore, the object of the present invention to provide a process for dyeing or printing cellulose fibers with azo dyestuffs produced on the fiber by treating the material with aqueous baths or printing pastes containing an azoic coupling component, the solution or dispersion of a diazotizable primary aromatic amine, an alkaline agent and sodium nitrite and subjecting the material to a subsequent acid treatment, which comprises using an amine containing a carboxylic acid ester or amide group.

To produce the dyeings by the process of the invention the coupling components known from ice-color techniques can be used. In the case of exhaust processes they preferably have a substantive character for the fiber material.

Compounds of this type couple in a position adjacent to a hydroxy group and do not contain solubilizing groups. There are especially mentioned aryl amides of aromatic or heterocyclic o-hydroxy-carboxylic acids or of acyl acetic acids and other aromatic or heterocyclic hydroxy compounds containing in a heterocyclic ring a keto-methylene group which is enolized or capable of being enolized. Substances of this type are, for example, aryl amides of 2,3-hydroxy-naphthoic acid, of 2-hydroxyanthracene-3-carboxylic acid, of 4-hydroxydiphenyl-3-carboxylic acid, of 2-hydroxycarbazol-3-carboxylic acid, of 3-hydroxydiphenylene oxide-2-carboxylic acid, of 3-hydroxy-diphenylene sulfide-2-carboxylic acid, of acetoacetic acid, or of benzoylacetic acid. There are further suited, inter alia, hydroxybenzenes, polyhydroxy-benzenes, hydroxy-naphthalenes and pyrazolones which may be substituted by nonionic radicals.

Suitable coupling components in printing and padding processes are preferably low or medium substantive aryl amides of aceto-acetic acid, of 2-hydroxy-naphthalene-3-carboxylic acid or of heterocyclic o-hydroxy-carboxylic acids, for example 5-chloro-2-acetoacetylamino-1,4-diethoxybenzene, 4,4'-bis-(acetoacetylamino)-3,3'-dimethyl-diphenyl, 2-acetoacetylamino-6-ethoxybenzthiazole, 2-hydroxy-naphthalene-3-carboxylic acid phenylamide, the derivatives thereof substituted in the phenylamide radical by lower alkyl or lower alkoxy groups or chlorine atoms, such as 2-hydroxy-naphthalene-3-carboxylic acid-(2'-methoxyphenyl-1')-amide, 2-hydroxy-naphthalene-3-carboxylic acid-(2'-methoxy-phenyl-1')-amide, 2-hydroxy-naphthalene-3-carboxylic acid-(3'-chloro-6'-methoxy-phenyl-1')-amide and 2-hydroxy-carboazole-3-carboxylic acid-(4'-chlorophenyl-1')-amide.

All non-diazotized primary aromatic amines containing at least one carboxylic acid amide or ester group and forming water-insoluble mono-, dis- or poly-azo dyestuffs with the aforesaid coupling components can be used, including heterocyclic amines besides the carbocyclic amines. Thus, practically all diazotizable primary aromatic amines can be used provided that they contain at least one carboxylic caid amide or ester group and do not contain any group rendering soluble in wter the azo dyestuff formed.

There are mentioned in the first place amines of the formula

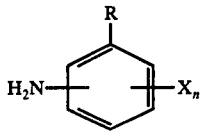

(I)

in which R represents a group of the formula $$-G-CO-O-R'; -G-O-CO-R'; -G-CO-NR'R'' \text{ or } -G-NR''-CO-R'$$

in which G stands for a group of the formula $$-(C_xH_{2x})-, -CH{=}CH- \text{ or } -N{=}N-Y-$$

$x$ being zero or an integer in the range of from 1 to 3,

Y represents phenylene or the group $>CH-Ac$ in which Ac stands for acetyl or benzoyl, R′ represents hydrogen or preferably an aliphatic or aromatic radical, R″ represents hydrogen or an aliphatic or aromatic radical, R″ and R′ possibly being linked with each other to form a ring, X represents identical or different non-solubilizing substituents or is defined as R, and $n$ stands for zero or an integer in the range of from 1 to 3.

Suitable substituents X at the nucleus are nitro, lower alkyl or lower alkoxy radicals, phenoxy, lower alkylsulfone, trifluoromethyl, or nitrile groups and/or halogen atoms, preferably chlorine atoms.

In view of their low price and easy accessibility, there are preferred aromatic amines containing ester groups and corresponding to the formulae

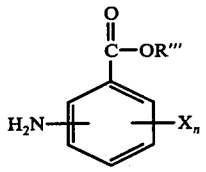

(IIa)

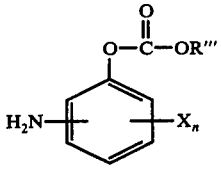

(IIb)

in which R‴ represents alkyl, aralkyl, aryl or hetaryl which may be substituted and the alkyl radicals preferably have from 1 to 4 carbon atoms; especially suitable are the methyl, trifluoromethyl or ethyl group. The preferred aralkyl radical is a substituted or unsubstituted benzyl radical while as aryl radical the phenyl radical is preferred which may be substituted, for example by halogen, preferably chlorine, nitro, methyl or methoxy radicals. Suitable hetaryl radicals are preferably the radicals of N-containing heterocyclic compounds.

Especially good results are obtained with compounds of formula II in which R‴ represents methyl or ethyl, for example 2-chloro-4-amino-benzoic acid methyl ester, 3,5-dichloro-2-amino-benzoic acid methyl ester, 5-nitro-2-amino-benzoic acid ethyl ester, 3-nitro-4-amino-benzoic acid ethyl ester, 4-aminobenzoic acid methyl ester, 4-amino-benzoic acid ethyl ester, 3-amino-4-chloro-benzoic acid methyl ester, 3-amino-benzoic acid methyl ester, 3-amino-4-chloro-benzoic acid ethyl ester, 3-amino-6-chlorobenzoic acid methyl ester, or 3-amino-6-chlorobenzoic acid ethyl ester. Additional suitable compounds are amino-cinnamic acid esters, for example 3-amino-cinnamic acid methyl ester, 4-amino-cinnamic acid methyl ester, 3-aminocinnamic acid ethyl ester and 4-amino-cinnamic acid ethyl ester, as well as derivatives of said esters substituted in the benzene nucleus, 5-amino-isophthalic acid dimethyl ester, or 4-aminobenzoic acid n-propyl ester.

Preferred amide compounds are those of the formulae

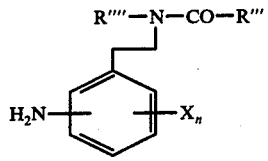

(IIIa)

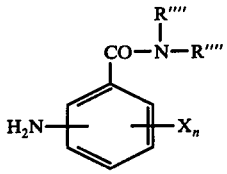

(IIIb)

in which R⁗ represents hydrogen or has the same meaning as R‴, and R‴ and R⁗ may be linked to each other to form a ring. In the case of formula III b, the radicals R⁗ are identical or different, preferably one radical R⁗ being hydrogen and the other one a possibly substituted phenyl radical.

Especially suitable compounds of formula III a are, for example, 1-methyl-2-amino-4-chloro-5-benzoylaminobenzene, 1-amino-3-methyl-4-benzoylamino-6-methoxybenzene, 1-methoxy-2-benzoyl-amino-4-chloro-5-aminobenzene, 1-amino-4-benzoylamino-2,5-diethoxybenzene, 1-amino-4-benzoylamino-2,5-dimethoxybenzene and 6-amino-4-benzoylamino-1,3-xylene and suitable compounds of formula III b are 3-amino-benzoic acid amide, 4-amino-benzoic acid amide, 3-amino-4-methoxy-benzoic acid amide, 3-methoxy-4-amino-benzoic acid amide, 3-amino-benzoic acid methylamide, 4-amino-benzoic acid anilide, 3-amino-benzoic acid anilide, 3-amino-benzoic acid-2′-chloroanilide, 4-chloro-3-amino-benzoic acid anilide, 5-nitro-2-amino-benzoic acid anilide, 3-amino-4-methoxy-benzoic acid anilide, 3-amino-4-methoxy-benzoic acid-3′-chloro-2′-methyl anilide, 6-amino-2-benzoylamino-1,4-dimethylbenzene, 4-amino-1-(4-nitro-benzoylamino)-benzene, 4-amino-2-benzoylamino-toluene, 6-amino-3-(N-ethylbenzoylamino)-toluene, 2-amino-4-acetamino-toluene, 2-amino-4-formylamino-toluene or compounds of the formulae

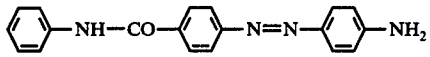

or

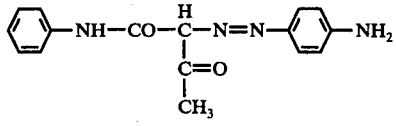

or derivatives thereof, for example the compound of the formula

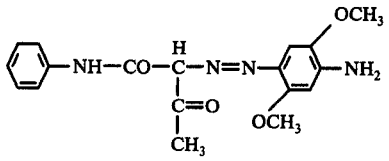

or

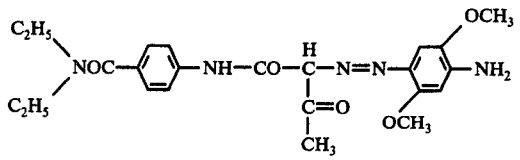

and analogous compounds.

Additional suitable compounds are 4-aminocinnamic acid amide and 4-aminocinnamic acid anilide.

For the dispersion of the amine there are used preferably, if necessary, anionic agents, for example alkyl sulfonates, alkylaryl sulfonates, aryl sulfonates, lignin sulfonates, sulfonated cresol-formaldehyde resins, formaldehyde-naphthalene-sulfonic acid condensation products, taurines and acylamino-sulfonic acids, especially the sodium salt of 2,2'-dinaphthyl-methane-6,6'-disulfonic acid or a mixture of oleylmethyl taurine and lignin sulfate.

Alternatively, non ionic agents can be used, optionally in admixture with anionic agents. Suitable non ionic agents are, for example, alkyl polyglycol ethers, alkylaryl polyglycol ethers, aryl polyglycol ethers, acyl polyglycol ethers and oxalkylated fatty amines.

The process according to the invention is used to dye known cellulosic fibers such as native fibers, for example flax, hemp, linen, or cotton, or regenerated fibers, for example viscose staple fibers, spun rayon and modal fibers (polynosic type). The cellulosic fibers can be used as such or in admixture with other fibers, for example polyester fibers.

As far as the process of the invention is carried out as exhaust process, the conditions set forth in British Pat. No. 1,422,995 are applied. Instead of the anionic dispersing agents mentioned in the aforesaid patent, in the present process other dispersing agents as indicated above can be used. Moreover, with the use of some of the amines, the dyestuff components can be dissolved separately, the amine being simply dissolved in water.

As compared with the process disclosed in the above British patent, the process of the present invention has the following advantages:

1. The dispersions or solutions have a higher stability.
2. The dispersing agents need no specific activity so that a greater number of substances can be used, for example non ionic dispersing agents.
3. The dyeing baths can be prepared with less precision so that the process becomes safer.
4. In some cases solvents for the amine need not be used.

When the process of the invention is carried out as jig-padding or slop padding process, the liquors can be prepared in known manner by dissolving the coupling components, in the manner usual in ice-color techniques, and dissolving or dispersing the amine and combining the solutions or solution and dispersion, preferably while adding a solvent and/or dispersing agent to the amine. Alternatively, the individual component can be jointly dissolved or dispersed.

The fibrous material is impregnated in known manner with the aqueous liquor containing the amine, the coupling component, an alkaline agent and sodium nitrite, for example by padding, nip-padding, spraying or dipping, or by applying in foam form.

As far as the process of the invention is carried out as printing process, the printing pastes are applied in usual manner. The material is then dried or immediately treated with acid, for example by acid steaming, padding, nip-padding, spraying, dipping, or foaming.

It proved advantageous to pass the material through air, or to heat or to steam it after printing. For developing, the usual inorganic and organic acids are used.

The after-treatment is effected by rinsing and soaping under the conditions used for the ice-color techniques. To bring up to shade a reactive dye may be added to the acid aqueous developing bath and, after complete coupling to form the azo dyestuff, optionally after intermediate drying, the reactive dye can be fixed by a treatment with an alkaline agent with subsequent heating or allowing to dwell for some time.

It is surprising that the amines used in the present process yield colorations which have a high fastness to wet processing as the hydrophilic carboxylic ester or amide group would rather point to a distinctly reduced fastness to wet processing. Moreover, it could have been expected that the diazotization would cause alterations of the amide or ester group resulting in non uniform shifting of the shade and useless results. Such changes of shade have, however, not been observed.

The numbers of the Colour Index indicated in the examples to characterize the dyestuffs were taken from the 2nd Edition 1956, the supplemental volume of 1963 and the 3rd Edition 1971.

The following examples illustrate the invention, the parts and percentages being by weight unless stated otherwise.

EXAMPLE 1

Cotton cross-wound bobbins were prepared for the dyeing process by boiling and bleaching. Next, the bobbins were treated at a goods-to-liquor ratio of 1:20 for 45 minutes at 30° C in a bath prepared as follows:

| | |
|---|---|
| 0.62 g/l | of 3-amino-benzoic acid ethyl ester were dissolved in water and added, while stirring, together with a solution obtained by cold dissolution of |
| 1.15 g/l | of Azoic Coupling Component 9 (C.I. No. 37,620) in |
| 6 ml/l | of ethanol, |
| 1.5 ml/l | of 32.5 % sodium hydroxide solution (38° Be) and |
| 3 ml/l | of water of 50° C, |
| | to an aqueous bath of 30° C having the following composition: |
| 6 ml/l | of 32.5 % sodium hydroxide solution (38° Be), |
| 3 g/l | of sodium 2,2'-dinaphthylmethane-6,6'-disulfonate, |
| 1 g/l | of sodium nitrite and |
| 20 g/l | of sodium chloride. |

After 30 minutes the liquor was pumped back into the preparing vessel and admixed with

| | |
|---|---|
| 1.8 ml/l | of 32.1 % hydrochloric acid (20° Be) and |
| 2 ml/l | of 60 % acetic acid. |

With the liquor obtained the textile material was treated for 30 minutes at 25° to 30° C.

After rinsing with cold and hot water, the material was treated with

| | |
|---|---|
| 1 g/l | of oleylmethyl taurine, |
| 1 g/l | of anhydrous sodium carbonate and |
| 1 g/l | of sodium tripolyphosphate, |

at 60° C and at boiling temperature, each time for 15 minutes, rinsed again and finished.

A greenish yellow coloration was obtained.

EXAMPLE 2

Knitted cotton fabric ready for dyeing was treated in a jet dyeing apparatus for 30 minutes at a goods-to-liquor ratio of 1:10 in an aqueous bath prepared as follows:

| | |
|---|---|
| 0.74 g/l | of 6-chloro-3-amino-benzoic acid ethyl ester were dissolved in water and added to a mixture of |
| 1.15 g/l | of Azoic Coupling Component 28 (C.I. No. 37,541), dissolved in |
| 6 ml/l | of ethanol, |
| 1.5 ml/l | of 32.5 % sodium hydroxide solution (38° Be) and |
| 3 ml/l | of water of 50° C. |

The solution obtained was added to an aqueous bath of 30° C having the following composition:

| | |
|---|---|
| 6 ml/l | of 32.5 % sodium hydroxide solution, |
| 3 g/l | of sodium 2,2'-dinaphthylmethane-6,6'-disulfonate, |
| 2 g/l | of crystalline sodium nitrite, |
| 20 g/l | of sodium chloride and |
| 4 g/l | of crystalline disodium phosphate. |

After a treating time of 30 minutes,

| | |
|---|---|
| 7.5 ml/l | of 32.1 % hydrochloric acid (20° Be) and |
| 0.75 ml/l | of 60 % acetic acid |

were metered into the circulating bath and the material was treated at a pH of about 5.9 for 30 minutes at 25° to 30° C.

The after-treatment was carried out as described in Example 1. A bright scarlet coloration having a high brilliancy was obtained.

EXAMPLE 3

The fabric was dyed under the conditions specified in Example 2 in a bath prepared as follows:

| | |
|---|---|
| 0.56 g/l | of 4-amino-cinnamic acid ethyl ester was dispersed in water with |
| 0.56 g/l | of a dispersing agent (according to Fiat Final Report 1013) and the dispersion obtained was added to a solution obtained by cold dissolution of |
| 1.15 g/l | of Azoic Coupling Component 9 (C.I. No. 37,620). |

The dispersiion obtained was added, while stirring, to an aqueous bath of 30° C having the composition specified in Example 2. The material was dyed and after-treated under the conditions of Example 2.

A full golden yellow coloration was obtained.

In the following table are summarized further combinations of dye-forming components, the amount thereof to be used and the colorations obtained on cellulose fibers under the conditions set forth above.

| Example | Coupling Component | amine | shade |
|---|---|---|---|
| 4 | 1.15 g/l Azoic Coupl. Component 9 C.I.No 37 620 | 0.5 g/l 4-amino-benzoic acid methyl ester | yellow |
| 5 | 1.15 g/l Azoic Coupl. Component 9 C.I.No. 37 620 | 0.7 g/l 4-chloro-2-amino-benzoic acid methyl ester | yellow |
| 6 | 1.15 g/l Azoic Coupl. Component 28 C.I.No. 37 541 | 1.14 g/l 4-nitro-2-amino-benzoic acid ethyl ester | orange |
| 7 | 1.15 g/l Azoic Coupl. Component 8 C.I.No. 37 525 | 1 g/l 4-amino-benzoic acid ethyl ester | red |
| 8 | 1.15 g/l Azoic Coupl. Component 12 C.I.No. 37 550 | 0.9 g/l 3-amino-benzoic acid ethyl ester | scarlet |
| 9 | 1.15 g/l Azoic Coupl. Component 32 C.I.No. 37 580 | 1.1 g/l 5-bromo-2-amino-benzoic acid methyl ester | red |
| 10 | 1.15 g/l Azoic Coupl. Component 4 C.I.No. 37 560 | 1.1 g/l 4-chloro-3-amino-benzoic acid methyl ester | red |
| 11 | 1.15 g/l Azoic Coupl. Component 32 C.I.No. 37 580 | 0.9 g/l 4-amino-cinnamic acid methyl ester | bordeaux |

EXAMPLE 12

| | |
|---|---|
| 20 g/l | of Azoic Coupling Component 12 (C.I. No. 37,550) were dissolved in |
| 30 ml/l | of ethanol, |
| 10 ml/l | of 32.5 % sodium hydroxide solution (38° Be) and |
| 25 ml/l | of water of 50 to 60° C. |
| 9.2 g/l | of 3-aminobenzoic acid ethyl ester were dissolved in water of 50° C and the solution was added to the solution of the coupling component additionally containing |
| 1 g/l | of lignin sulfonate. |

The solution obtained was added, while stirring, to a padding liquor containing

| | |
|---|---|
| 20 ml/l | of 32.5 % sodium hydroxide solution (38° Be) and |
| 20 g/l | of sodium nitrite. |

Bleached and mercerized cotton fabric was treated with the padding liquor at a liquor pickup of 60 to 70% and dried.

After drying, the material was steamed for 30 seconds in overheated steam of 130° C containing formic acid and acetic acid. Next, the material was treated in usual manner by rinsing with cold and hot water, soaping at boiling temperature and rinsing with hot and cold water.

After drying, a clear and brilliant red coloration was obtained.

Alternatively, the coloration can be developed by passing the material through an acid bath with subsequent air passage, drying or steaming.

EXAMPLE 13

| | |
|---|---|
| 20 g/kg | of Azoic Coupling Component 20 (C.I. No. 37,530; in the following: "naphtholate") were dissolved with |

-continued

| | |
|---|---|
| 40 ml/kg | of ethanol, |
| 30 g/kg | of β,β-dihydroxy-diethyl sulfide and |
| 13 ml/kg | of 32.5 % sodium hydroxide solution (38° Be) by adding |
| 50 ml/kg | of water of 60 to 70° C, |
| 12 g/l | of 6-chloro-3-amino-benzoic acid ethyl ester were dissolved in water and the solution added to the naphtholate solution. |

400 Parts of a 6% aqueous thickening of a locust bean flour ether, diluted with 300 parts of water, were successively blended with the naphtholate solution, the amine solution and a solution of 20 g/kg of sodium nitrite dissolved in 40 ml of water.

Bleached and mercerized cotton fabric was printed with the printing paste so obtained and dried. The print was then subjected for 20 seconds to the action of superheated steam of 130° C containing formic acid and acetic acid. Finally, the fabric was after-treated in usual manner. A dark red print was obtained.

EXAMPLE 14

| | |
|---|---|
| 20 g/l | of Azoic Coupling Component 24 (C.I. No. 37,540; in the following: "naphtholate") were dissolved with |
| 30 ml | of ethanol, |
| 20 ml | of 32.5 % sodium hydroxide solution (38° Be) and |
| 40 ml | of water. |
| 13 g/l | of 4-amino-cinnamic acid ethyl ester were dispersed with water/ethylene glycol and |
| 1.5 g/l | of the compound of the formula |

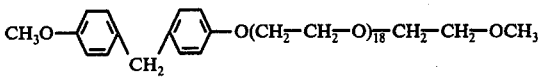

and 20 g/l of sodium nitrite were added.

The amine dispersion obtained was stirred into the naphtholate bath and made up to 1 liter.

Mercerized and bleached cotton fabric was impregnated with this padding liquor and dried. A mixture of hydrochloric acid and acetic acid was applied as a foam onto the dried material which was then steamed and after-treated. Alternatively, the material can be treated with a somewhat higher acid concentration, rolled up and allowed to dwell at room temperature for some time. A very dark claret shade (bordeaux) was obtained.

EXAMPLE 15

| | |
|---|---|
| 1) 20 g/l | of Azoic Coupling Component 13 (C.I. No. 37,595) were dissolved in |
| 10 ml | of ethanol and |
| 20 ml | of water of 40° C. |
| 2) 8 g/l | of 4-aminobenzoic acid methyl ester were dissolved in hot water and |
| 0.5 g/l | of a dispersing agent on the basis of lignin-sulfonic acid was added. |
| 3) 10 g/l | of sodium nitrite were dissolved in 30 ml of hot water. |

The 3 solutions were successively stirred into water of 90° C containing

| | |
|---|---|
| 0.5 g/l | of dispersing agent on the basis of lignin sulfonate and |
| 5 g/l | of a condensation product of naphthalene sultonate with formaldehyde and adjusted to 1 liter. |

A cotton warp or a cotton fabric were padded at a liquor pickup of 60 to 70% and dried.

Development was brought about by cross padding with

| | |
|---|---|
| 40 ml/l | of 60 % acetic acid and |
| 10 g/l | of sodium acetate with subsequent drying. |

When a cotton warp is used it may be sized in the acid bath.

After having carried out the usual after-treatment (in the case of the cotton warp the after-treatment only being effected after weaving with white weft yarn) a black shade was obtained.

The following table summarized further combinations of dyestuff-forming components, the amounts to be used and the shades obtained on cellulose fibers.

| Example | Coupling Component | primary aromatic amine | shade |
|---|---|---|---|
| 16 | 40 g/l Azoic Coupl.Component 9, C.I.No. 37 620 | 25.8 g/l 3-amino-benzoic acid methyl ester | yellow |
| 17 | 20 g/l Azoic Coupl.Component 5, C.I.No. 37 610 | 37.8 g/l 4-amino-benzoic acid methyl ester | golden yellow |
| 18 | 40 g/l Azoic Coupl. Component 9, C.I.No. 37 620 | 34.1 g/l 6-chloro-3-amino-benzoic acid ethyl ester | old gold |
| 19 | 20 g/l Azoic Coupl.Component 5, C.I.No. 37 610 | 8.4 g/l 4-amino-cinnamic acid ethyl ester | golden orange |
| 20 | 20 g/l Azoic Coupl.Component 18, C.I.No. 37 520 | 9.2 g/l 3-amino-benzoic acid ethyl ester | orange |
| 21 | 20 g/l Azoic Coupl.Component 28, C.I.No. 37 541 | 13.7 g/l 4-nitro-2-amino-benzoic acid ethyl ester | orange |
| 22 | 20 g/l Azoic coupl.Component 8, C.I.No. 37 525 | 13.7 g/l 4-chloro-2-amino-benzoic acid methyl ester | scarlet |
| 23 | 20 g/l Azoic Coupl.Component 4, C.I.No. 37 560 | 14.4 g/l 4-nitro-2-amino-benzoic acid ethyl ester | red |
| 24 | 20 g/l Azoic Coupl.Component 34, C.I.No. 37 531 | 12.6 g/l 4-chloro-3-amino-benzoic acid methyl ester | red |
| 25 | 20 g/l Azoic Coupl.Component 12, C.I.No. 37 550 | 8.0 g/l 4-amino-benzoic acid methyl ester | dark red |
| 26 | 20 g/l Azoic Coupl.Component 8, C.I.No. 37 525 | 15.2 g/l 4-amino-benzoic acid ethyl ester | dark red |
| 27 | 20 g/l Azoic Coupl.Component 32, C.I.No. 37 580 | 10.7 g/l 4-amino-cinnamic acid ethyl ester | bordeaux |
| 28 | 20 g/l Azoic Coupl.Component 15, C.I.No. 37 600 | 12.4 g/l 5-bromo-2-amino-benzoic acid methyl ester | brown |
| 29 | 40 g/l Azoic Coupl.Component 16, C.I.No. 37 605 | 12.1 g/l 5-chloro-2-amino-benzoic acid methyl ester | blackish brown |
| 30 | 80 g/l Azoic Coupl.Component 13, C.I.No. 37 595 | 24.8 g/l 2-chloro-4-amino-benzoic acid ethyl ester | black |

-continued

| Example | Coupling Component | primary aromatic amine | shade |
|---|---|---|---|
| | | methyl ester | brown |
| 31 | 60 g/l Azoic Coupl.Component 107, C.I.No. - | 21.6 g/l 4-nitro-2-amino-benzoic acid ethyl ester | very dark grey |
| 32 | 60 g/l Azoic Coupl.Component 107, C.I.No. - | 19.2 g/l 4-chloro-2-amino-benzoic acid | dark reddish |

EXAMPLE 33

After purification in usual manner by boiling, cotton crosswound bobbins were treated for 45 minutes at 30° C at a goods-to-liquor ratio of 1:20 in a bath prepared as follows:

| | |
|---|---|
| 0.82 g/l | of 2-chloro-4-amino-acetanilide, which is substantially soluble in water, was stirred up and fully dissolved with |
| 1.15 g/l | of Azoic Coupling Component 32 (C.I. No. 37,580), |
| 6 ml/l | of ethanol, |
| 1.5 ml/l | of 32.5 & sodium % solution (38° Be) and |
| 3 ml/l | of water of 50° C |

and the solution obtained was introduced, while stirring, into an aqueous bath of 30° C of the following composition:

| | |
|---|---|
| 6 ml/l | of 32.5 % sodium hydroxide solution (38° Be), |
| 3 g/l | of sodium 2,2'-dinaphthylmethane-6,6'-disulfonate, |
| 20 g/l | of sodium chloride and |
| 1 g/l | of sodium nitrite. |

A limpid dark brown solution was obtained.

After 45 minutes, the bath was recycled by pumping into the preparing vessel and in said vessel it was admixed with

| | |
|---|---|
| 2.5 ml/l | of 32.1 % hydrochloric acid (20° Be) and |
| 1.5 ml/l | of 60 % acetic acid. |

The textile material was treated in this bath for 30 minutes at 25° to 30° C. Next, it was rinsed with hot and cold water, treated with a solution of

| | |
|---|---|
| 1 g/l | of oleylmethyl taurine, |
| 1 g/l | of anhydrous sodium carbonate and |
| 1 g/l | of sodium tripolyphosphate |

for 45 minutes each at 60° C and at boiling temperature, and rinsed with hot and cold water. A deep dark red coloration was obtained.

EXAMPLE 34

Boiled and bleached knitted cotton fabric was treated in a jet dyeing apparatus for 30 minutes at a goods-to-liquor ratio of 1:10 with an aqueous liquor prepared as follows:

| | |
|---|---|
| 0.81 g/l | of 4-amino-benzoic acid methyl amide dissolved in water were dissolved with |
| 1.15 g/l | of Azoic Coupling Component 28 (C.I. No. 37, 341), |
| 6 ml/l | of ethanol, |
| 1.5 ml/l | of 32.5 % sodium hydroxide solution (38° Be) and |
| 50 ml/l | of water of 40° C |

and the solution was introduced, while stirring, into an aqueous bath of 30° C containing

| | |
|---|---|
| 6 ml/l | of 32.5 % sodium hydroxide solution (38° Be), |
| 3 g/l | of sodium 252'-dinaphthylmethane-6,6'-disulfonate, |
| 2 g/l | of crystalline sodium nitrite and |
| 20 g/l | of sodium chloride. |

After a treatment time of 30 minutes

| | |
|---|---|
| 3.5 ml/l | of 32.1 % hydrochloric acid (° Be) and |
| 2 ml/l | of 60 % acetic acid |

were added by means of an additional pump, the pH of the bath was adjusted to about pH 5.9 and the fabric was treated for a further 20 minutes at about 25 to 30° C.

After rinsing with cold and hot water, the fabric was treated with

| | |
|---|---|
| 1 g/l | of oleylmethyl taurine, |
| 1 g/l | of anhydrous sodium carbonate and |
| 1 g/l | of sodium tripolyphosphate, |

each time for 10 minutes at 60° C and at boiling temperature, rinsed again and finished.

A dark brilliant scarlet coloration having an excellent fastness to light was obtained.

In the following table are summarized further combinations of dyestuff-forming components to be used under the conditions of Examples 33 and 34, the amounts thereof and the shades produced on cellulose fibers.

| Example | Coupling Component | primary aromatic amine | shade |
|---|---|---|---|
| 35 | 1.15 g/l Azoic Coupl.Component 9, C.I.No. 37 620 | 0.82 g/l 3-amino-4-methoxy-benzoic acid anilide | yellow |
| 36 | 1.15 g/l Azoic Coupl.Component 4, C.I.No. 37 560 | 0.8 g/l 3-amino-benzoic acid amide | orange |
| 37 | 1.15 g/l Azoic Coupl.Component 28, C.I.No. 37 541 | 1.2 g/l 3-amino-benzoic acid anilide | scarlet |
| 38 | 1.15 g/l Azoic Coupl.Component 12, C.I.No. 37 550 | 0.8 g/l 3-amino-benzoic acid methyl amide | red |
| 39 | 1.15 g/l Azoic Coupl.Component 12, C.I.No. 37 550 | 0.8 g/l 3-amino-4-methoxy-benzoic acid 3-chloro-2'-methyl anilide | red |
| 40 | 1.15 g/l Azoic Coupl.Component 32, C.I.No. 37 580 | 1.16 g/l 1-methyl-2-amino-4-chloro-5-benzoylaminobenzene | bordeaux |
| 41 | 1.15 g/l Azoic Coupl.Component 4, C.I.No. 37 560 | 1.78 g/l 1-amino-4-benzoylamino-2,5-diethoxybenzene | navy blue |
| 42 | 1.15 g/l Azoic Coupl.Component 15, C.I.No. 37 600 | 0.76 g/l 6-amino-4-benzoylamino-1,3-xylene | |

EXAMPLE 43

| | |
|---|---|
| 20g/l | of Azoic Coupling Component 4 (C.I. No. 37,560) were dissolved with |
| 30 ml/l | of ethanol, |

-continued

| | |
|---|---|
| 10 ml/l | of 32.5 % sodium hydroxide solution (38° Be) and |
| 25 ml/l | of water of 50 to 60° C. |
| 9 g/l | of 4-aminobenzoic acid methyl amide were dissolved in water of 50° C and |
| 1 g/l | of lignin sulfate were added. |

Both solutions were added, while stirring, to a padding liquor containing

| | |
|---|---|
| 20 ml/l | of 32.5 % sodium hydroxide solution (38° Be) and |
| 20 g/l | of sodium nitrite. |

Bleached and mercerized cotton fabric was treated with the padding liquor obtained at a liquor pickup of 60 to 70% and dried.

After drying, the fabric was steamed for 30 seconds with superheated steam of 130° C containing formic acid and acetic acid. The fabric was then after-treated in usual manner by rinsing with cold and hot water, soaping at boiling temperature, and rinsing again with hot and cold water. After drying, a clear and brilliant red coloration having good wet fastness and very good fastness to light was obtained. Alternatively, the dyestuff can be developed by an acid passage with subsequent air passage, drying or steaming.

EXAMPLE 44

| | |
|---|---|
| 20 g/kg | of Azoic Coupling Component 8 (C.I. No. 37,525; in the following: "naphtholate") were dissolved with |
| 40 ml/kg | of ethanol, |
| 30 g/kg | of $\beta,\beta$-dihydroxydiethyl sulfide, |
| 13 ml/kg | of 32.5 % sodium hydroxide solution (38° Be) and |
| 50 ml/kg | of water of 60 to 70° C |
| 10 g/l | of 2-chloro-4-amino-acetanilide were dissolved in water containing |
| 2 g/l | of caster oil fatty acid polyglycol ether. |

First, the naphtholate solution, then the amine solution and finally a solution of 20 parts of sodium nitrite in 40 parts of water were stirred into 400 parts of a 6% aqueous thickening of locust bean flour ether, diluted with 300 parts of water.

Bleached and mercerized cotton fabric was printed with the printing paste so obtained and dried. The fabric was then treated for 20 seconds with superheated steam of 130° C containing formic acid and acetic acid and further treated in usual manner.

A red print having good fastness properties was obtained.

EXAMPLE 45

| | |
|---|---|
| 20 g/l | of Azoic Coupling Component 11 /C.I. No. 37,535; in the following: "naphtholate") |

-continued

| | |
|---|---|
| | were dissolved with |
| 30 ml | of ethanol, |
| 20 ml | of 32.5 % sodium hydroxide solution and |
| 40 ml | of water. |
| 13.6 g/l | of 3-amino-benzoic acid anilide and |
| 1.5 g/l | of the compound of formula |

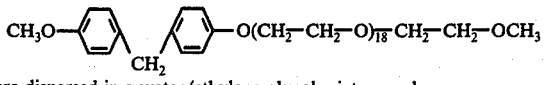

were dispersed in a water/ethylene glycol mixture and

| | |
|---|---|
| 20 g/l | of sodium nitrite were added. |

The amine dispersion was introduced, while stirring, into the naphtholate bath and the whole was made up to 1 liter.

Mercerized and bleached cotton fabric was impregnated with the padding liquor obtained and dried. A mixture of hydrochloric acid and acetic acid was foamed onto the dried fabric, the fabric was steamed and further treated. Alternatively, a somewhat higher acid concentration can be used, whereupon the fabric is rolled up and allowed to dwell for some time at room temperature.

A brilliant scarlet coloration having excellent fastness to light and wet processing is obtained.

EXAMPLE 46

| | | |
|---|---|---|
| 1) | 20 g/l | of Azoic Coupling Component 18 (C.I. No. 37,560) were dissolved with |
| | 10 ml/l | of 32.5 % sodium hydroxide solution (38° Be), |
| | 10 ml/l | of ethanol and |
| | 20 ml/l | of water of 40° C. |
| 2) | 15 g/l | of 1-amino-4-benzoylamino-2,5-diethoxybenzene were dispersed with |
| | 2 g/l | of a dispersing agent on the basis of lignin sulfonic acid in approximately 100 ml of water. |
| 3) | 10 g/l | of sodium nitrite were dissolved in 30 ml/l of hot water. |

The three solutions were successively stirred into water of 90° C containing 5 g/l of a condensation product of naphthalene sulfonate with formaldehyde.

A cotton warp or cotton fabric was padded at a liquor pickup of 60 to 70% and dried.

The dyestuff was developed by cross padding with 40 ml/l of 60% acetic acid and 10 g/l of sodium acetate with subsequent drying.

When a cotton warp is used it can also be sized in an acid bath.

After the usual after-treatment (in the case of the warp yarn only after weaving with a white weft yarn), a dark blue coloration was obtained In the following table are summarized further combinations of dyestuff-forming components to be used under the aforesaid conditions, the amounts thereof and the shades obtainable on cellulose fibers.

| Example | Coupling Component | primary aromatic amine | shade |
|---|---|---|---|
| 47 | 20 g/l Azoic Coupl.Component 5, C.I.No. 37 610 | 8.6 g/l 3-amino-benzoic acid amide | golden yellow |
| 48 | 20 g/l Azoic Coupl.Component 9, C.I.No. 37 620 | 10.0 g/l 3-amino-benzoic acid methyl amide | yellow |
| 49 | 20 g/l Azoic Coupl.Component 18, C.I.No. 37 520 | 13.6 g/l 3-amino-benzoic acid anilide | orange |
| 50 | 20 g/l Azoic Coupl.Component 20, C.I.No. 37 530 | 8.6 g/l 3-amino-benzoic acid amide | reddish orange |
| 51 | 20 g/l Azoic Coupl.Component 18, C.I.No. 37 520 | 13 g/l 3-amino-benzoic acid-n-butyl amide | reddish orange |
| 52 | 20 g/l Azoic Coupl.Component 28, C.I.No. 37 541 | 14.5 g/l 2-chloro-4-amino-acetanilide | scarlet |
| 53 | 20 g/l Azoic Coupl.Component 24, C.I.No. 37 540 | 12.6 g/l 3-amino-4-methoxy-benzoic acid amide | red |
| 54 | 20 g/l Azoic Coupl.Component 11, C.I.No. 37 535 | 9 g/l 4-amino-benzoic acid amide | covered red |

-continued

| Example | Coupling Component | primary aromatic amine | shade |
|---|---|---|---|
| 55 | 20 g/l Azoic Coupl.Component 34, C.I.No. 37 531 | 13 g/l 3-amino-4-methoxy-benzoic acid anilide | bright red |
| 56 | 20 g/l Azoic Coupl.Component 20, C.I.No. 37 530 | 14.6 g/l 3-amino-4-methoxy-benzoic acid 3'-chloro-2'-methyl anilide | red |
| 57 | 20 g/l Azoic Coupl.Compoonent 4, C.I.No. 37 560 | 14.6 G/l 3-amino-4-methoxy-benzoic acid 3'-chloro-2'-methyl anilide | bordeaux |
| 58 | 20 g/l Azoic Coupl.Component 12, C.I.No. 37 550 | 14.5 g/l 2-chloro-4-aminoacetanilide | currant red |
| 59 | 20 g/l Azoic Coupl.Component 2, C.I.No. 37 505 | 19 g/l 1-amino-3-methyl-4-benzoylamino-6-methoxybenzene | violet |
| 60 | 20 g/l Azoic Coupl.Component 15, C.I.No. 37 600 | 13.6 g/l 3-amino-benzoic acid anilide | brown |
| 61 | 20 g/l Azoic Coupl.Component 16, C.I.No. 37 605 | 13 g/l 3-amino-4-methoxy-benzoic acid anilide | blackish brown |
| 62 | 20 g/l Azoic Coupl.Component 13, C.I.No. 37 595 | 10.9 g/l 4-amino-benzoic acid methyl-amide | black |
| 63 | 20 g/lAzoic Coupl.Component 18, C.I.No. 37 520 | 21 g/l 1-amino-4-benzoylamino-2,5-dimethoxy-benzene | blue |

What is claimed is:

1. In a process for dyeing or printing cellulose fibers with azo dyestuffs produced on the fiber by treating with an aqueous liquor or printing paste containing an azoic coupling component, a solution or dispersion of a diazotizable primary aromatic amine, an alkaline agent and sodium nitrite with subsequent acid treatment, the improvement comprising using a diazotizable primary aromatic amine which contains a carboxylic acid ester or amide group, and which does not contain any group rendering soluble in water the azo dyestuff formed.

2. The process of claim 1, wherein the amine has the formula

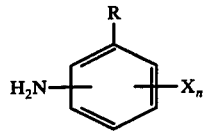

in which R represent a group of the formula $$-G-CO-O-R'; -G-O-CO-R'; -G-CO-NR'R'' \text{ or } -G-NR''-CO-R'$$

in which G stands for a group of the formula $$-(C_xH_{2x})-, -CH=CH- \text{ or } -N=N-Y-$$

$x$ being zero or an integer in the range of from 1 to 3, $Y$ represents phenylene or the group $>CG-Ac$ in which Ac stands for acetyl or benzoyl, R' and R'' represent hydrogen or aliphatic or aromatic radicals, and may be linked with each other to form a ring, X represents identical or different non-solubilizing substituents or is defined as R, and $n$ stands for zero or an integer in the range of from 1 to 3.

* * * * *